US006044622A

United States Patent [19]

Brady et al.

[11] Patent Number: 6,044,622

[45] Date of Patent: Apr. 4, 2000

[54] METHOD AND APPARATUS FOR PRODUCING A PACKAGE HAVING A PEELABLE FILM WITH A TAB TO FACILITATE PEELING

[75] Inventors: Sean A. Brady, Greer; Robert Babrowicz, Spartanburg; Robin H. Logan, Moore; James R. Mabry; Jeff C. McConnell, both of Spartanburg; Robin D. Owens, Greer, all of S.C.

[73] Assignee: Cryovac, Inc., Duncan, S.C.

[21] Appl. No.: 09/228,316

[22] Filed: Jan. 11, 1999

[51] Int. Cl.[7] ..... B65B 61/18; B65B 11/52

[52] U.S. Cl. ..... 53/412; 53/427; 53/509; 53/133.3; 53/329.5; 53/478; 426/129; 426/396

[58] Field of Search ..... 53/133.1, 133.3, 53/412, 329.5, 427, 509, 370.4, 373.4, 478, 432, 510; 426/129, 396

[56] References Cited

U.S. PATENT DOCUMENTS

| | | | |
|---|---|---|---|
| Re. 30,009 | 5/1979 | Perdue et al. . | |
| 3,491,504 | 1/1970 | Young et al. . | |
| 3,574,642 | 4/1971 | Weinke | 99/174 |
| 3,681,092 | 8/1972 | Titchenal et al. | 99/174 |
| 3,713,849 | 1/1973 | Grindrod et al. | 99/174 |
| 4,055,671 | 10/1977 | Mahaffey et al. | 426/123 |
| 4,055,672 | 10/1977 | Hirsch et al. | 426/127 |
| 4,196,809 | 4/1980 | Tonrey | 206/534 |
| 4,285,430 | 8/1981 | Caunt | 206/471 |
| 4,287,151 | 9/1981 | Esakov et al. | 264/560 |
| 4,382,513 | 5/1983 | Schirmer et al. | 206/484 |
| 4,638,913 | 1/1987 | Howe, Jr. | 206/632 |
| 4,766,018 | 8/1988 | Hinrichsen et al. | 428/35 |
| 4,875,587 | 10/1989 | Lulham et al. | 206/484 |
| 4,886,690 | 12/1989 | Davis et al. | 428/36.6 |
| 4,889,731 | 12/1989 | Williams, Jr. | 426/106 |
| 4,952,628 | 8/1990 | Blatz | 525/58 |
| 4,956,212 | 9/1990 | Bekele | 428/36.6 |
| 4,977,004 | 12/1990 | Bettle, III et al. | 428/36.7 |
| 5,075,143 | 12/1991 | Bekele | 428/36.6 |
| 5,106,688 | 4/1992 | Bradfute et al. | 428/215 |
| 5,346,735 | 9/1994 | Logan et al. | 418/36.7 |
| 5,402,622 | 4/1995 | Stockley, III et al. | 53/427 |
| 5,718,101 | 2/1998 | Noel | 53/432 |
| 5,770,287 | 6/1998 | Miranda et al. | 428/40.1 |

FOREIGN PATENT DOCUMENTS

| | | |
|---|---|---|
| 245 774 | 2/1961 | Australia . |
| 224 0 234 | 4/1973 | Germany . |

*Primary Examiner*—Linda Johnson
*Attorney, Agent, or Firm*—Thomas C. Lagaly

[57] ABSTRACT

A packaging method and apparatus perform the steps of:

a. providing a film including a first film component peelably adhered to a second film component;

b. providing a support member for supporting a product thereon;

c. forming a seal between the second film component and the support member, the seal extending around the product to define a sealed enclosure for the product between the film and the support member;

d. separating the first film component from the second film component within a predetermined region of the film located outside of the sealed enclosure; and e. severing the film within the predetermined, separated region to form an edge on the first film component within the separated region, thereby providing a tab for peeling the first film component from the second film component.

18 Claims, 6 Drawing Sheets

METHOD AND APPARATUS FOR PRODUCING A PACKAGE HAVING A PEELABLE FILM WITH A TAB TO FACILITATE PEELING

BACKGROUND OF THE INVENTION

The present invention relates to packaging for products, such as fresh red meat or other food products, that are enclosed between a support member and a film, wherein the film can be peelably delaminated to alter its gas-permeability, thereby changing the environmental conditions within the package. More specifically, the invention relates to a method and apparatus for producing such packaging and providing the film with a tab to facilitate the peelable delamination thereof.

Various forms of packaging, particularly for food products, employ a relatively rigid support member, such as a flat sheet or tray, upon or in which a product is supported. The product is typically covered by a relatively flexible, transparent film. The film is bonded to the support member around the product, generally by forming a heat-seal between the film and support member, to thereby enclose the product between the film and support member. Examples of this type of packaging include vacuum skin packaging and modified-atmosphere packaging.

In vacuum skin packaging, the film is thermoformable, i.e., capable of being formed into a desired shape upon the application of heat, and is thermoformed about the product on a support member by means of heat and differential pressure. Virtually all of the air is evacuated from the interior of the package so that the film conforms very closely to the contour of the packaged product. Generally, sufficient heat is applied to cause the film to bond with the support member outside the periphery of the product, either by employing a heat-activatable adhesive at the interface of the film and support member or by forming the film and support member from materials that are otherwise sealingly compatible upon the application of heat, e.g., by employing similar polymeric materials, such as polyethylenes, at the seal interface that bond to one another when heated. Alternatively, a pressure-sensitive adhesive can be used. Further details are described in, e.g., U.S. Pat. Nos. Re 30,009 (Purdue et al.), 5,346,735 (Logan et al.), and 5,770,287 (Miranda et al.), the disclosures of which are hereby incorporated herein by reference.

In modified-atmosphere packaging, a food product is generally packaged in a tray-like support member having a peripheral flange to which the film is secured. Prior to securing the film to the support member, air is generally evacuated from the interior of the support member and replaced by a gas which extends the shelf-life of the packaged product.

In these and similar types of packaging applications, both the film and support member generally comprise materials which form a barrier to the passage of gas therethrough so that the package is, at least initially, substantially gas-impermeable. Eventually, a portion of the film is removed by a retailer prior to placing the package in a display case for consumer purchase. The latter event occurs where it is desirable to increase the gas-permeability of the film in order to allow air (oxygen) to come into contact with the packaged product while still providing protection to the product from, e.g., dirt, dust, moisture, and other contaminates. This is generally desirable where air-contact with the packaged product renders the product more appealing to the consumer in some way.

For example, while a low-oxygen packaging environment generally increases the shelf-life of a packaged fresh red meat product (relative to meat products packaged in an environment having a higher oxygen content), red meat has a tendency to assume a purple color when packaged in the absence of oxygen or in an environment having a very low oxygen concentration, i.e., below about 5% oxygen. Such a purple color is undesirable to most consumers, and marketing efforts to teach the consumer about the acceptability of the purple color have been largely ineffective. When meat is exposed to a sufficiently high concentration of oxygen, e.g., as found in air, it assumes a bright red color which most consumers associate with freshness. After 1 to 3 days of such exposure, however, meat assumes a brown color which, like the purple color, is undesirable to most consumers (and indicates that the meat is beginning to spoil). Thus, in order to effectively butcher and package fresh red meat products in a central facility for distribution to retail outlets, the meat is packaged, shipped, and stored in a low-oxygen (vacuum or modified-atmosphere) environment for extended shelf-life, and then displayed for consumer sale in a relatively high-oxygen environment such that the meat is caused to "bloom" into a red color just before being placed in a retail display case.

The foregoing may be accomplished by providing a film that peelably delaminates into a gas-permeable portion and a substantially gas-impermeable portion, with the gas-permeable portion being bonded to the support member so that the gas-impermeable portion can be peelably removed from the package. In this manner, the package may be shipped with the upper, gas-impermeable portion secured to the lower, gas-permeable portion to maintain a low-oxygen environment within the package during shipping. Then, the gas-impermeable portion may be peelably removed at the supermarket just prior to placing the package in a retail display case. Since the remaining portion of the film is permeable to gas (oxygen), it allows the meat product to bloom in the presence of oxygen which enters the package from the ambient atmosphere. This general packaging concept is also applicable to poultry, which assumes a pink color in the presence of oxygen but has a longer shelf-life in a low-oxygen environment, as well as to other perishable foods such as cheese and produce.

Regardless of the particular type of peelable package that is employed, e.g., a vacuum skin package or modified-atmosphere package, it is desirable that the film have a tab which can be manually grasped to facilitate peeling and removal of the gas-impermeable portion from the gas-permeable portion. Such a peel tab would desirably be provided without the need to add additional components to the package, and would also be provided in the same process in which the package is made, i.e., without the need for a separate "off-line" process. It would also be desirable for the package having such a peel tab to be aesthetically appealing both prior to and after peelable delamination of the film.

SUMMARY OF THE INVENTION

The foregoing desired features are met by the packaging method and apparatus of the present invention as will now be described.

In accordance with one aspect of the present invention, a packaging method is provided, comprising the steps of:

a. providing a film comprising a first film component peelably adhered to a second film component;

b. providing a support member for supporting a product thereon;

c. forming a seal between the second film component and the support member, the seal extending around the product to define a sealed enclosure for the product between the film and the support member;

d. separating the first film component from the second film component within a predetermined region of the film located outside of the sealed enclosure; and e. severing the film within the predetermined, separated region to form an edge on the first film component within the separated region, thereby providing a tab for peeling the first film component from the second film component.

The first and second film components are preferably separated by directing fluid pressure between the first and second film components within the predetermined region of the film. The predetermined film region in which the first and second film components may be defined by applying to the film a containment force sufficient to substantially prevent the fluid pressure from separating the first and second film portions within the sealed enclosure.

In accordance with another aspect of the present invention, a packaging apparatus is provided, comprising:

a. a mechanism for carrying a support member having a product thereon;

b. an apparatus for positioning a film over the support member, the film comprising a first film component peelably adhered to a second film component;

c. a device for forming a seal between the second film component and the support member, the seal extending around the product to define a sealed enclosure for the product between the film and the support member;

d. an apparatus for separating the first film component from the second film component within a predetermined region of the film located outside of the sealed enclosure; and e. a mechanism for severing the film within the predetermined, separated region to form an edge on the first film component within the separated region, thereby providing a tab for peeling the first film component from the second film component.

Where the product to be packaged is meat, poultry, cheese, produce, or other oxygen-sensitive product, the first film component is preferably substantially gas-impermeable while the second film component s preferably gas-permeable. Thus, in a preferred embodiment of the invention, the package is a vacuum skin package for an oxygen-sensitive product and the film delaminates into a substantially gas-impermeable portion and a gas-permeable portion, with the gas-permeable portion being bonded directly to the support member of the package. The gas-impermeable portion may be peelably removed from the package by grasping and pulling the peel tab back across the package, thereby allowing atmospheric oxygen to enter the interior of the package via the remaining gas-permeable portion so that the product is altered in a desirable way.

Accordingly, the peel tab in accordance with the present invention is formed only from the film material used to enclose the product so that no additional materials are required to form the peel tab. Thus, the number of package components is not increased. Further, the process for forming the peel tab can be performed in the same process in which the package is made with minimal modifications to existing packaging equipment. In addition, the peel tab can be made into any desired shape or size, and thus results in an aesthetically appealing package both for the retailer and the consumer.

DETAILED DESCRIPTION OF THE INVENTION

Figure 1:
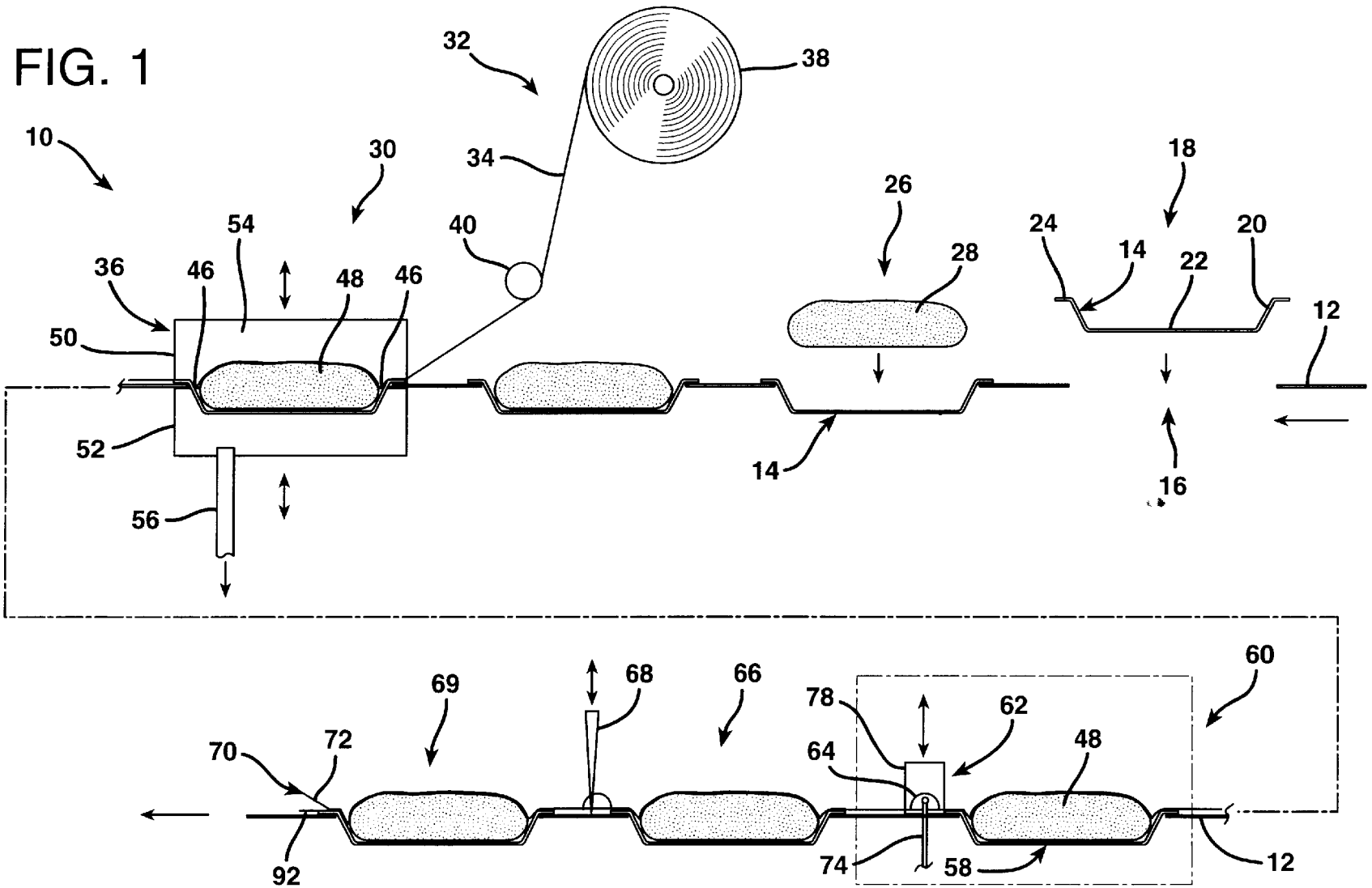
FIG. 1 is a schematic illustration of an apparatus and method for making packages in accordance with the present invention.

FIG. 1 shows a packaging apparatus 10 for carrying out a packaging method in accordance with the present invention. Apparatus 10 includes a mechanism 12 for carrying one or more, preferably a plurality, of support members 14. The carrying mechanism 12 may be any suitable mechanism capable of supporting and transporting support members 14 through each of the process steps as will be described below. Preferably, the carrying mechanism is in the form of a continuous belt or series of pivotally-linked plates (e.g., similar to the tracks on a tank) having spaces 16 in which a continuous series of support members 14 can be held and carried through apparatus 10. Thus, at packaging station 18 of apparatus 10, empty support members 14 arc loaded into spaces 16 of carrying mechanism 12 either manually or by a suitable loading apparatus (not shown). If desired, carrying mechanism 12 may be adapted to accommodate two or more rows of support members 14, with each of the packaging stations of apparatus 10 (as described below) being correspondingly adapted (e.g., widened), so that two or more rows of packages may be processed in parallel at each packaging station.

Support members 14 are preferably in the form of trays having side walls 20, a base 22, and a peripheral flange 24 extending outwardly from the side walls 20. The support members 14 can have any desired configuration or shape, e.g., rectangular, round, oval, etc. Similarly, flange 24 may have any desired shape or design, including a simple, substantially flat design as shown, or a more elaborate design such as, e.g., those disclosed in U.S. Pat. Nos. 5,348,752 and 5,439,132, the disclosures of which are hereby incorporated herein by reference. Alternatively, the support members may be in the form of substantially flat sheets.

Suitable materials from which support members 14 can be formed include, without limitation, polyvinyl chloride, polyethylene terephthalate, polystyrene, polyolefins such as high density polyethylene or polypropylene, paper pulp, nylon, polyurethane, etc. The support members may be foamed (expanded) or non-foamed as desired, and preferably provides a barrier to the passage of oxygen therethrough, particularly when used for packaging products that are oxygen-sensitive (i.e., those that degrade in the presence of oxygen, such as meat, poultry, pork, produce, certain cheeses, etc.). When such oxygen-sensitive products are to be packaged in a low-oxygen environment (to thereby extend their shelf-life), support members 14 preferably allow less than or equal to about 1000 cc of oxygen to pass therethrough (per square meter of material per 24 hour period at 1 atmosphere and at a temperature of 73° F.), more preferably less than about 500 cc of oxygen, more preferably still less than about 100 cc, even more preferably less than about 50 cc, and most preferably less than about 25 cc of oxygen to pass. Support members 14 may be formed from a material which itself provides a barrier to the passage of oxygen, e.g., vinylidene chloride copolymer, nylon, polyethylene terephthalate, ethylene/vinyl alcohol copolymer, etc. Alternatively, support members 14 may have a substantially gas-impermeable sealant film laminated or otherwise bonded to the inner (upper) surface thereof as disclosed in U.S. Pat. Nos. 4,847,148 and 4,935,089, and in U.S. Ser. No. 08/326,176, filed Oct. 19, 1994 and entitled "Film/Substrate Composite Material" (published as EP 0 707 955 A1 on Apr. 24, 1996), the disclosures of which are hereby incorporated herein by reference. As used herein, the phrase "sealant film" refers to a film which is conformably bonded to at least one of the exterior surfaces of the product support member. Preferably, the sealant film is bonded to the upper, as opposed to the lower, exterior surface of the support member and is a substantially gas-impermeable film. The sealant film thus preferably includes an oxygen-barrier material such as e.g., vinylidene chloride copolymer (saran), nylon, polyethylene terephthalate, ethylene/vinyl alcohol copolymer, etc.

After support members 14 are loaded onto carrying mechanism 12 at packaging station 18, the empty support members advance to packaging station 26 where product 28 is loaded into the support members, again either manually or by a suitable loading apparatus (not shown). Alternatively, products 28 can be pre-loaded on support members 14 prior to loading the support members onto carrying mechanism 12, so that each support member already contains a product 28 thereon when the support members are loaded onto carrying mechanism 12 at packaging station 18. This would, of course, eliminate the need for packaging station 26.

Although the packaging method and apparatus of the present invention can be used to package virtually any type of product 28, as will be appreciated, the method and apparatus 10 are ideally suited for packaging oxygen-sensitive products, such as those selected from the group consisting of meat, poultry, cheese, and produce.

Advancing next to packaging station 30, apparatus 32 provides and positions film 34 over the product 28 and support member 14 in vacuum skin packaging (VSP) chamber 36. Apparatus 32 may include a dispensing roll 38 from which a web of film 34 is supplied, and one or more positioning rolls 40 (only one shown) for guiding the film web 34 into the VSP chamber 36 and positioning the film over the support member 14. As discussed in greater detail below, film 34 is preferably transparent, and comprises a first (upper) film component 42 peelably adhered to a second (lower) film component 44 (see FIG. 2).

VSP chamber 36 is a device that forms a seal 46 between the second component 44 of film 34 and the support member 14. Seal 46 is preferably a heat-seal (i.e., a heat-induced fusion between two surfaces), and extends around product 28 to define a sealed enclosure 48 for the product between film 34 and support member 14. As shown, seal 46 is formed between film 34 and both the upper surface of flange 24 and the inner surface of a portion of side walls 20 of support member 14. However, depending on the size of product 28 in relation to support member 14, seal 46 may or may not extend down into support member 14 along the inner surface of side walls 20. For example, if product 28 was sufficiently large, seal 46 would only be between film 34 and the upper surface of flange 24.

VSP chamber 36 can be any conventional VSP device, e.g., that which is described in the above-referenced U.S. Pat. No. Re 30,009 (Purdue et al.), and preferably includes upper and lower chamber halves 50 and 52, respectively, which can be separated to assume an "open" position and then brought together to assume a "closed" position. As shown in FIG. 1, this may be accomplished when one or both of the chamber halves 50, 52 are vertically translatable as indicated by the arrows. Thus, when the chamber halves translate away from one another to assume an "open" position (not shown), carrying mechanism 12 moves a support member 14 with an uncovered product 28 into VSP chamber 36 between the chamber halves. Then, the chamber halves translate towards one another until VSP chamber 36 assumes a "closed" position as shown. In the closed position, the two chamber halves 50, 52 form a substantially gas-impermeable enclosure 54. Seal 46 is preferably formed by heating film 34 sufficiently to cause it to bond with support member 14 around the periphery of the product 28. Means for heating the film, such as, e.g., steam lines or electrical resistors, may conveniently be provided in the upper or lower chamber halves 50 or 52 (not shown).

It is also preferred that the enclosure 54 formed by chamber halves 50, 52 be at least partially evacuated, and more preferably almost completely evacuated, before forming seal 46. In this manner, sealed enclosure 48 will be at least partially evacuated so that product 28 will be enclosed in a low-oxygen environment within the sealed enclosure. This is preferred when product 28 is oxygen-sensitive, i.e., perishable, degradable, or otherwise changeable in the presence of oxygen, such as fresh red meat products (e.g., beef, pork, veal, lamb, etc.), poultry (e.g., chicken, turkey, etc.), fish, cheese, fruits, or vegetables.

Evacuation of enclosure 54, and thereby sealed enclosure 48, may be accomplished by including a mechanism, such as evacuation port 56 in lower chamber half 52 as shown (and/or in upper chamber half 50 if desired). Evacuation port 56 is preferably in fluid communication with a suitable vacuum pump (not shown) that is operated when VSP chamber 36 is in the closed position as shown, and prior to and during the formation of seal 46. In this manner, a vacuum skin package 58 is formed upon completion of operations in packaging station 30.

Any desired amount of air may be removed from the enclosure during evacuation, e.g., ranging from 1% to 99.999% by volume. In the case where a fresh red meat, pork, or poultry product is to be packaged, the amount of air removed preferably ranges from about 99% to about 99.999%, and more preferably from about 99.5% to about 99.999% by volume.

Suitable VSP chambers with attendant film positioning apparatus are commercially available, and include, e.g., Cryovac® VS-44, Multivac® CD6000, and Multivac® R570CDP VSP machines.

In an alternative embodiment, packaging station 30 may include a modified-atmoshere packaging (MAP) chamber. Such a chamber is similar to VSP chamber 36, except that after the enclosure 54 is evacuated, a replacement gas is introduced into the chamber, again prior to forming seal 46, so that the product 28 and a portion of the replacement gas are contained within the sealed enclosure 48. Preferred gases to replace the evacuated air include, e.g., carbon dioxide, nitrogen, argon, etc., and mixtures of such gases. As a result of these steps, the sealed enclosure of a resultant modified-atmosphere package will contain less than 1% oxygen by volume, more preferably less than 0.5% oxygen, even more preferably less than 0.1% oxygen, and most preferably, less than 0.05% oxygen by volume, with the balance comprising a replacement gas or mixture of gases, such as a mixture of carbon dioxide and nitrogen.

Referring still to FIG. 1, vacuum skin packages (VSPs) 58 are transported via carrying mechanism 12 from packaging station 30 to packaging station 60. As will be discussed in greater detail below in conjunction with FIGS. 2–5, packaging station 60 includes an apparatus 62 for separating the first film component 42 from the second film component 44 (see FIG. 2) within a predetermined region 64 of film 34 located outside of sealed enclosure 48.

After packaging station 60, the VSPs 58 are next transported to packaging station 66. As will be discussed in greater detail below in conjunction with FIGS. 6–8, packaging station 66 includes a mechanism 68 for severing film 34 within the predetermined, separated region 64 to form an edge 70 on the first film component 42 within the separated region 64, thereby providing a tab 72 for peeling the first film component 42 from the second component 44 of film 34. If desired, an extended portion 92 of second film component 44 may be provided to further facilitate peeling.

Following packaging station 66, the completed VSPs 58 arrive at off-loading station 69, at which the VSPs are removed from apparatus 10, either manually or automatically, for shipment to a retail facility such as a grocery store.

Figure 2:
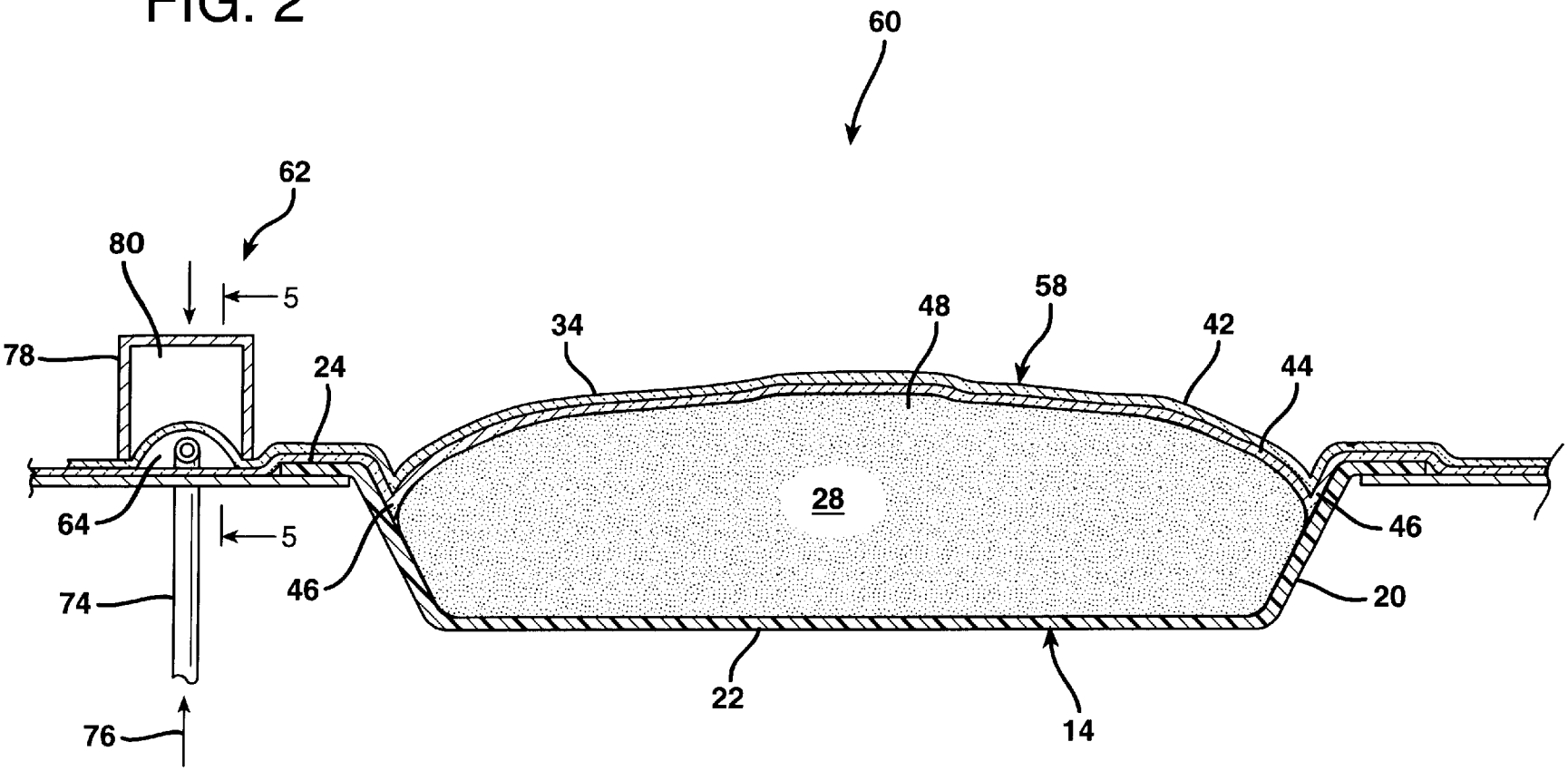
FIG. 2 is an enlarged cross-sectional view of packaging station 60 as shown in FIG. 1.

As noted above, film 34 comprises first film component 42 peelably adhered to second film component 44 (see FIG. 2). Preferably, the first component 42 peelably separates from the second component 44 when the first component 42 is subjected to a minimum peel force ranging from about 0.001 to 2.5 pounds per inch, i.e., the bond strength between the first and second film components 42 and 44 falls within the range of about 0.001 to 2.5 pounds per inch. More preferably, the minimum peel force at which components 42 and 44 separate falls with the range of about 0.01 to about 0.5 pounds per inch and, most preferably, from about 0.02 to about 0.05 pounds per inch. A bond strength of more than 2.5 lb/inch may result in a film that is more difficult to peel, or can result in unintentional separation of the entire film from the support member during peeling. On the other hand, a bond strength of less than about 0.001 lb/inch may create a greater likelihood of premature separation of first component 42 from second component 44.

When product 28 is a fresh red meat, pork, or poultry product, or when the product is cheese or produce, it is preferred that first film component 42 is substantially gas-impermeable and second film component 44 gas-permeable. As used herein, the phrase "gas-permeable" refers to a film or film portion which admits at least about 1,000 cc of gas, such as oxygen, per square meter of film per 24 hour period at 1 atmosphere and at a temperature of 73° F. (at 0% relative humidity). More preferably, a gas-permeable film or film portion admits at least 5,000, even more preferably at least 10,000, such as at least 15,000, 20,000, 25,000, 30,000, 35,000, 40,000, and 50,000, and most preferably at least 100,000 cc of oxygen per square meter per 24 hour period at 1 atmosphere and at a temperature of 73° F. (at 0% relative humidity).

As used herein, the phrase "substantially gas-impermeable" refers to a film or film portion which admits less than 1000 cc of gas, such as oxygen, per square meter of film per 24 hour period at 1 atmosphere and at a temperature of 73° F. (at 0% relative humidity). More preferably, a substantially gas-impermeable film admits less than about 500, such as less than 300, and less than 100 cc of gas; more preferably still less than about 50 cc, and most preferably less than 25 cc, such as less than 20, less than 15, and less than 10 cc of gas per square meter per 24 hour period at 1 atmosphere and at a temperature of 73° F. (at 0% relative humidity).

When first film component 42 is gas-impermeable, it preferably includes one or more materials that provide a substantial barrier to the passage of gas, particularly oxygen, therethrough. Suitable materials include, e.g., vinylidene chloride copolymers (saran), nylon, polyethylene terephthalate, ethylene/vinyl alcohol copolymer, silicon oxides (SiOx), etc. When second film component 44 is gas-permeable, it may be constructed to have sufficient gas-permeability for the intended application by, e.g., forming component 44 from a highly gas-permeable material (e.g., polymethyl pentene), chemically or mechanically altering film component 44 (e.g., perforating film component 44 or reducing the thickness thereof), and combinations of the foregoing. In this manner, product 28 can be packaged, shipped, and stored in a controlled atmospheric state designed to maximize the shelf-life of the product, e.g., under vacuum or in a modified atmosphere, with a gas-impermeable first film component 42 maintaining such controlled atmospheric state within the package. Subsequently, the package can be displayed for consumer purchase in another atmospheric state that serves to enhance the appearance of the product at the expense of shelf-life, e.g., air from the surrounding environment which causes fresh red meat, poultry, and pork to bloom, while the product remains enclosed in the same package. This is accomplished by peelably removing the gas-impermeable first film component 42 from the package and allowing air to come into contact with the product by way of the gas-permeable second film component 44, which remains sealed to the support member and continues to enclose the product and protect it from contact with dirt, dust, moisture, and other external contaminates.

Film 34 may be a multilayer, coextruded film having two adjacent layers at the interface of first and second components 42, 44 that adhere to one another with a relatively weak bond-strength, preferably ranging from about 0.001 to 2.5 pounds per inch as noted above. The inter-layer adhesion between such adjacent layers represents the weakest cohesive or adhesive bond within 34 so that the film will peel at the interface of first and second components 42, 44 when the film is subjected to a peel force of sufficient magnitude, i.e., higher than the adhesive force between the first and second film components 42, 44. Peelable separation in this manner may be achieved by constructing film 34 such that one of the adjacent layers at the interface of components 42, 44 comprises a nonpolar material while the other adjacent layer at such interface comprises a polar material. For example, one of the adjacent layers may comprise non-polar polyethylene homopolymer or copolymer while the other adjacent layer comprises at least one material selected from the group consisting of polyamide, copolyamide, polyester, copolyester such as polyethylene terephthalate, polar polyethylene copolymers such as ethylene/vinyl alcohol, polycarbonate, polymethylpentene, polyvinylidene chloride copolymer, polyurethane, polybutylene homopolymer and copolymer, and polysulfone. Alternatively, one of the adjacent layers at the interface may comprise polyethylene homopolymer or copolymer while the other adjacent layer comprises polypropylene homopolymer or copolymer.

Preferred examples of multilayer, coextruded films that are suitable for film 34 in accordance with the present invention are described in the above-referenced U.S. Pat. No. 5,770,287 (Miranda et al.).

As an alternative, film 34 may be a composite film comprising a laminate of two separate films which, when laminated together, become first and second film components 42 and 44. Lamination is carried out in such a way that the two film components can subsequently be separated by peeling along the interface at which the components were laminated. Any such composite film may include two or more component films that are bonded together by any suitable means, including adhesive bonding; reactive surface modification (e.g., corona treatment, flame treatment, or plasma treatment); heat treatment; pressure treatment; etc., including combinations thereof.

In addition, film 34 may be a composite film that delaminates within a coextruded, multilayer film that is a component of a laminate of two or more films. An example of such a film is disclosed in co-pending patent application Ser. No. 08/764,405, entitled "LAMINATE HAVING A COEXTRUDED, MULTILAYER FILM WHICH DELAMINATES AND PACKAGE MADE THEREFROM," filed Dec. 11, 1996, the disclosure of which is hereby incorporated herein by reference thereto.

Figure 3:
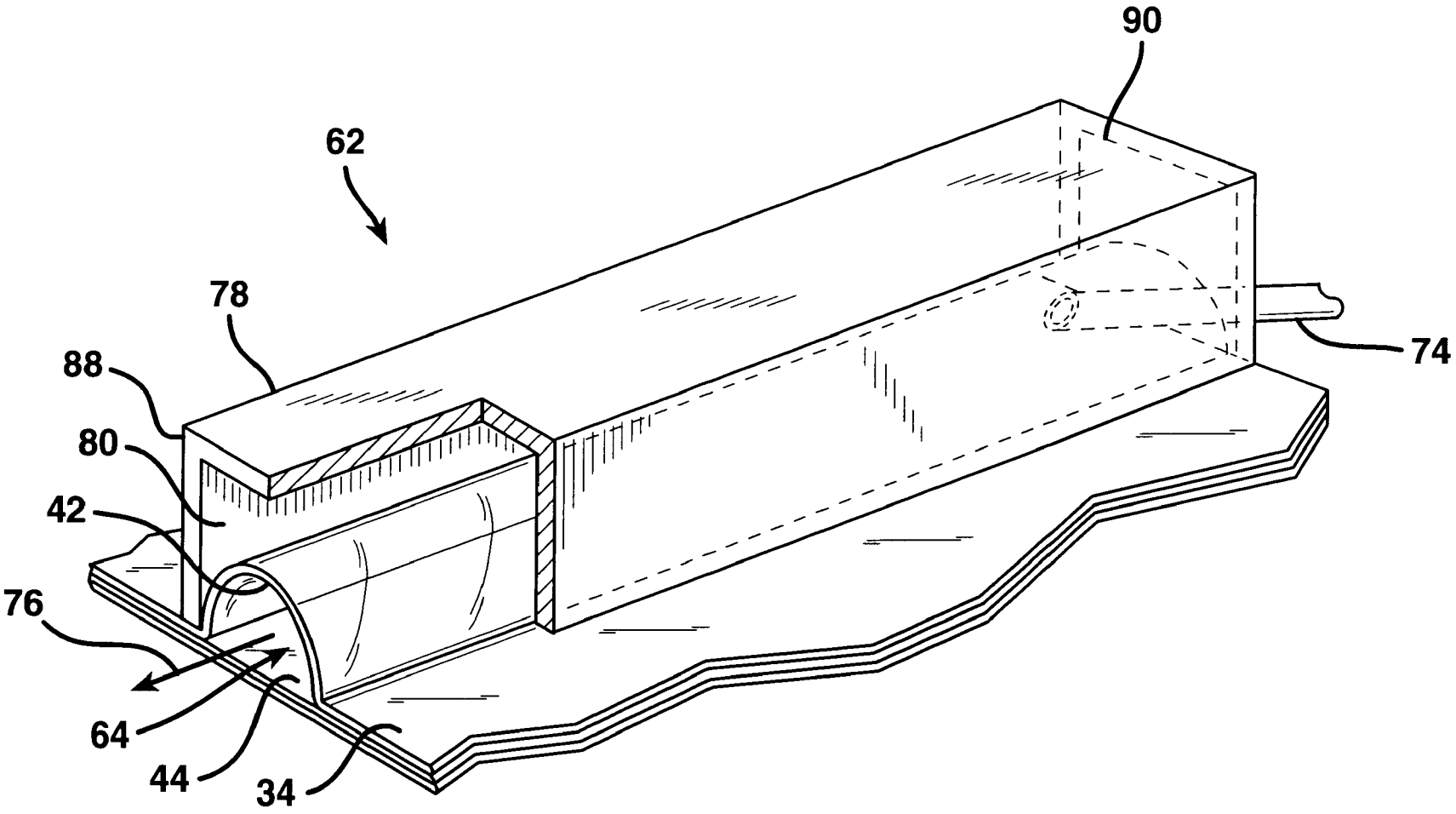
FIG. 3 is a perspective, partially cut-away view of the channeling device 78 and separated region 64 of film 34 as shown in FIG. 2.

Referring now to FIGS. 2–3, the operation of packaging station 60 will be described in greater detail. As noted above, the primary function of packaging stations 60 and 66 is to provide the packages 58 with a tab to facilitate peeling and removal of the first film component 42 from the second component 44 of film 34. At packaging station 60, first film component 42 is separated from the second film component 44 within a predetermined region 64 of film 34. This region 64 is located outside of sealed enclosure 48 so that, when first film component 42 is gas-impermeable and second component 44 is gas-permeable, the gas-impermeable component 42 will continue to prevent air from contacting product 28. Otherwise, if the separated region 64 were located on any part of film 34 in contact with product 28, air could come into contact with the product via the exposed portion of the second, gas-permeable film component 44 located within the separated region 64.

Preferably, separating apparatus 62 causes separation of the first and second film components 42, 44 by directing fluid pressure between the first and second film components within the predetermined region 64. Preferably, the fluid pressure is supplied by air or other gas (e.g., carbon dioxide, nitrogen, etc.). The fluid pressure could also be supplied by a liquid, such as water. Regardless of the fluid medium selected, it may conveniently be delivered to the predetermined region 64 by inserting a nozzle 74 between first and second film components 42, 44 as shown and introducing air 76 (or other fluid) into the region 64 through the nozzle.

Separating apparatus 62 preferably defines the predetermined region of separation 64 by applying a containment force to film 34 sufficient to substantially prevent the fluid pressure from nozzle 74 from separating the first and second film portions 42, 44 within the sealed enclosure 48. Such containment force can be provided by pressing a channeling device 78 into contact with film 34, i.e., outside of sealed enclosure 48 as shown. Channeling device 78 has an internal channel 80 to contain the fluid pressure therewithin, and thereby prevents the separated region 64 from expanding outside of the boundaries defined by the channeling device 78. Channeling device 78 is preferably translatable between two positions (as indicated by the double arrow in FIG. 1): an "up" position" (not shown) to allow VSPs 58 to move beneath the device 78 when carrying mechanism 12 transports the VSPs between packaging stations 60 and 66; and a "down" position (as shown) to contain the fluid pressure from nozzle 74 within predetermined region 64.

Figure 7:
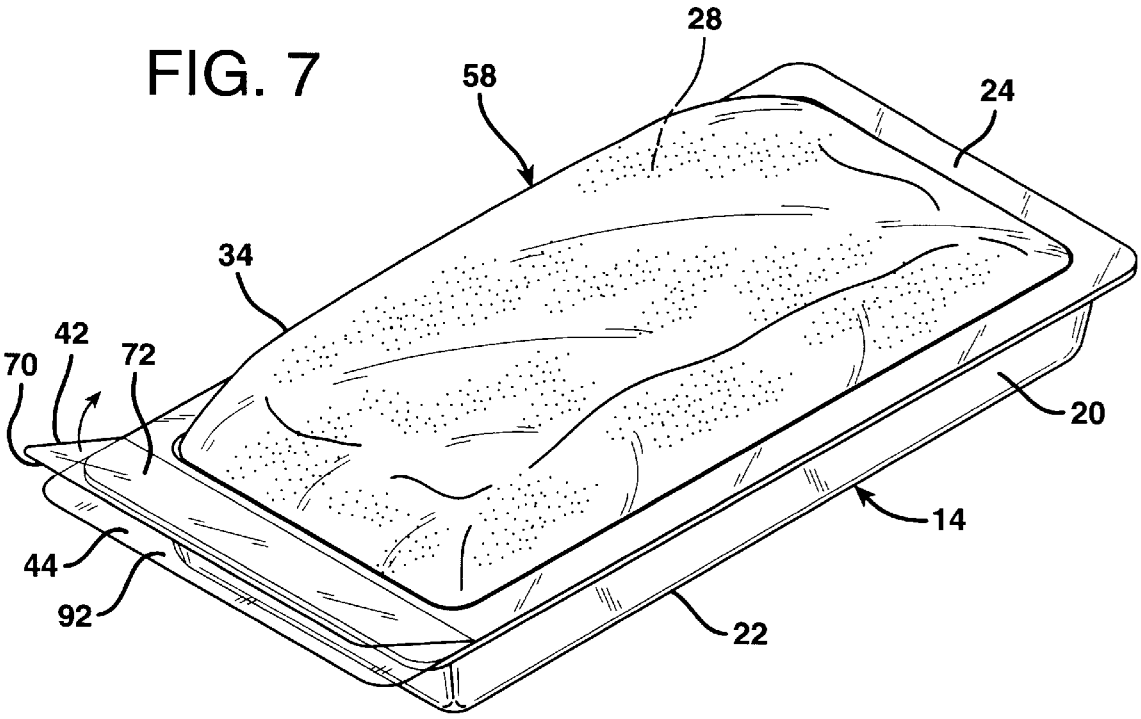
FIG. 7 is a perspective view of a package having a peel tab made by the process and apparatus shown in FIGS. 1–6.

Accordingly, channeling device 78 in conjunction with fluid pressure provided by nozzle 74 form a region 64 in which first film component 42 is separated from second film component 44. The shape, size, and location of region 64 is predetermined based on the shape, size, and position of channeling device 78. As illustrated, region 64 has the shape of a flattened or semi-circular tube with its longitudinal or major axis oriented essentially transversely to the direction in which carrying mechanism 12 moves the VSPs 58 through packaging apparatus 10. It is preferably positioned exterior to support member 14 and adjacent flange 24 thereof. In this manner, when the tube/region 64 is severed in packaging station 66, the resultant peel tab 72 will have the shape of a flap that extends along the width of the finished VSPs 58 as shown in FIG. 7.

It should be understood, however, that the shape, size, and position of region 64/tab 72 as illustrated in the drawings are not in any way intended to be limiting toward the scope of the present invention. Rather, a number of different possibilities for the ultimate configuration of peel tab 72 are envisioned. For example, region 64 could be located wholly or partially on top of flange 24. As noted previously, the only limitation with respect to the location of region 64 is that it should not extend into any portion of film 34 which is in direct contact with product 28, i.e., the sealed enclosure 48. Channeling device 78 (and/or severing mechanism 68) may have any desired shape, size or placement to result in, e.g., a more rounded peel tab or a smaller peel tab than the one shown in FIG. 7, or one that is located at one of the corners of the package, etc. Thus, the peel tab 72 may have any desired shape, size, or location on VSP 58.

Figure 4:
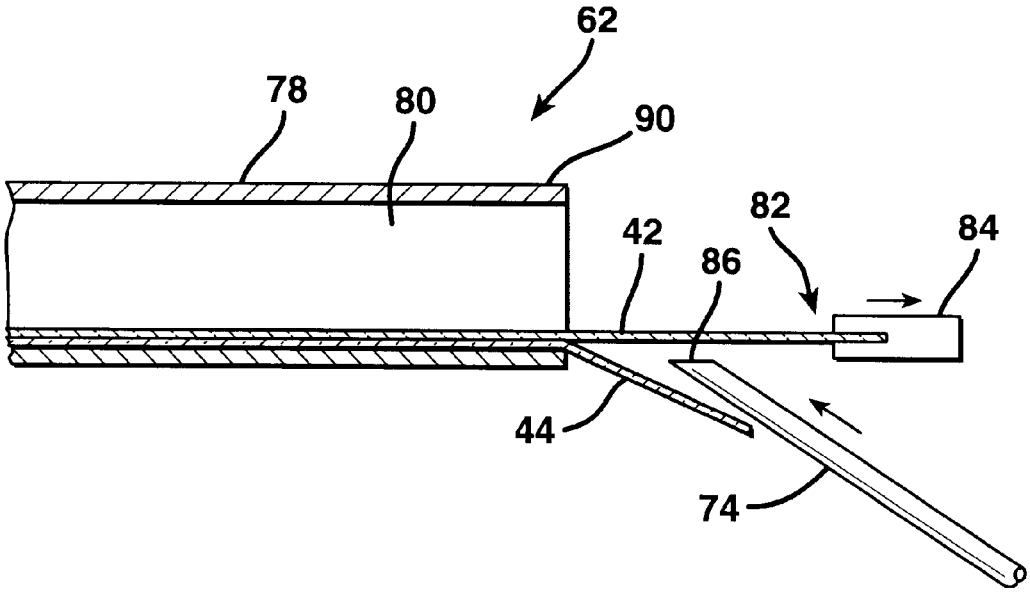
FIG. 4 is similar to FIG. 5, except that nozzle 74 has not yet been inserted between first and second film components 42 and 44.
Figure 5:
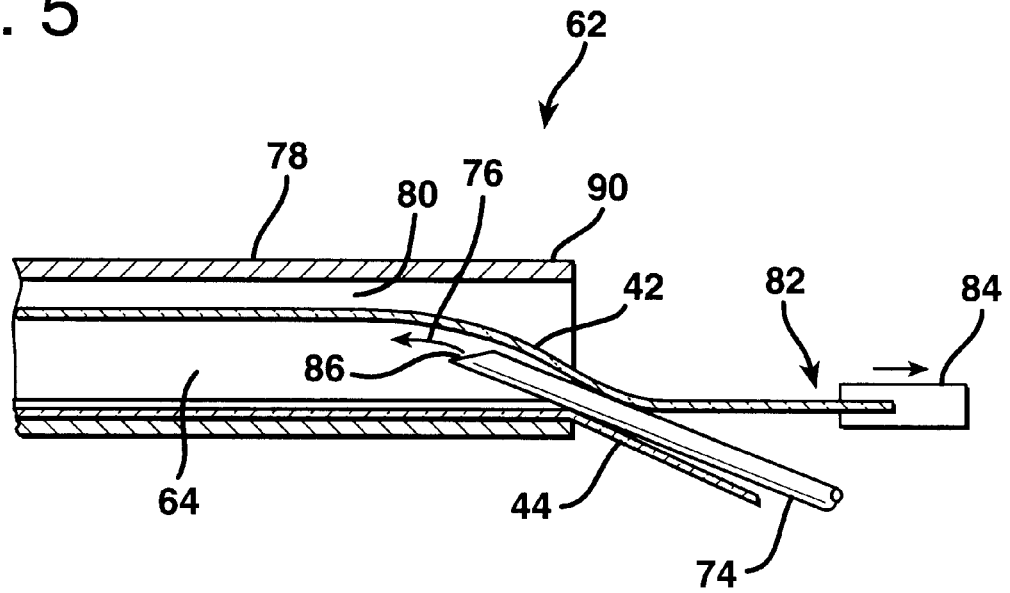
FIG. 5 is a cross-sectional view of channeling device 78, taken along lines 5—5 in FIG. 2.

FIGS. 4 and 5 illustrate a preferred means for inserting nozzle 74 between first and second film components 42, 44 so that fluid pressure can be applied thereto to form separated region 64. At one edge 82 of film 34, a portion (not shown) of second film component 44 has been removed so that the first film component 42 extends beyond the second film component 44 at edge 82 as shown. Edge 82 is preferably one of the two longitudinal edges of the web of film 34. A portion of second film component 44 may be removed at edge 82 by longitudinally slitting film component 44 just inboard of the actual film edge with a suitable cutting instrument. Slitting may be facilitated by using a curved blade held against a roll of film 34 in a pre-formed slit in second component 44 as the film is pulled from the roll. Subsequently or contemporaneously, a continuous strip of the film component 44 is removed from the remainder of component 44 outboard of the slit as disclosed in, e.g., U.S. Pat. No. 5,402,622 (Stockley, III et al.), the disclosure of which is hereby incorporated herein by reference thereto. The severed edge strip may be removed from film component 44 prior to installing film web 34 on dispensing roll 38, e.g., shortly after the film has been manufactured, or it may be removed as the film 34 is dispensed from roll 38.

It is also preferred that a series of clamps 84 (only one shown) be attached to first film component 42 at edge 82 to apply a slight tensioning force to film component 42. Nozzle 74 of separating apparatus 62 then directs fluid pressure between the first and second film components 42, 44 where first film component 42 extends beyond second film component 44 as shown. Preferably, with clamps 84 holding first film component 42 taught, nozzle 74 is forceably inserted between film components 42 and 44 in the area where film component 42 extends beyond component 44 (FIG. 4). Then, as shown in FIG. 5, nozzle 74 is further inserted between first and second film components 42, 44 until the discharge end 86 is within the channel 80 of channeling device 78. At that point, air 76 from a suitable source in fluid communication with nozzle 74, such as a pump (not shown), is forced through nozzle 74 and directed between first and second film components 42, 44 to separate the two film components in region 64 as bounded by channeling device 78. Preferably, a sufficient volume of air is sent through nozzle 74 to completely separate first and second film components 42, 44 in channeling device 78. Any excess air may be vented from the end 88 of channeling device 78 that is opposite the end 90 into which nozzle 74 is inserted (FIG. 3).

As an alternative to the foregoing, a portion of the first film component 42 may be removed (instead of from the second film component 44 as shown) so that the second film component 44 would extend beyond the first component 42. The operation of the nozzle 74 and clamps 84 would then be the reverse of that depicted in FIGS. 4–5. As a further alternative, instead of simply allowing excess air to vent from end 88 of channeling device 78 as shown, a second nozzle 74 and series of clamps 84 may be employed (preferably with the removal of a portion of either the first or second film component 42 or 44 at both longitudinal edges of film 34) at end 88 to force fluid between the first and second film components 42, 44 from both edges of film 34. This may be desired, e.g., where the width of film 34 is such that it would take too much time to force air through region 64 across the entire width of the film (i.e., when processing several rows of packages in parallel).

As a further alternative, instead of removing a portion of either first or second film components 42 or 44 at an edge of film 34, the film components can be held apart by mechanical means at an edge of the film, e.g., by using two sets of clamps similar to clamps 84, with one clamp set attached to film component 42 and the other clamp set attached to film component 44 at an edge of film 34. Nozzle 74 or other means for exerting fluid pressure can then be inserted between the two clamp sets holding film components 42, 44 apart, thereby producing separated region 64 within channeling device 78 as described above.

Figure 6:
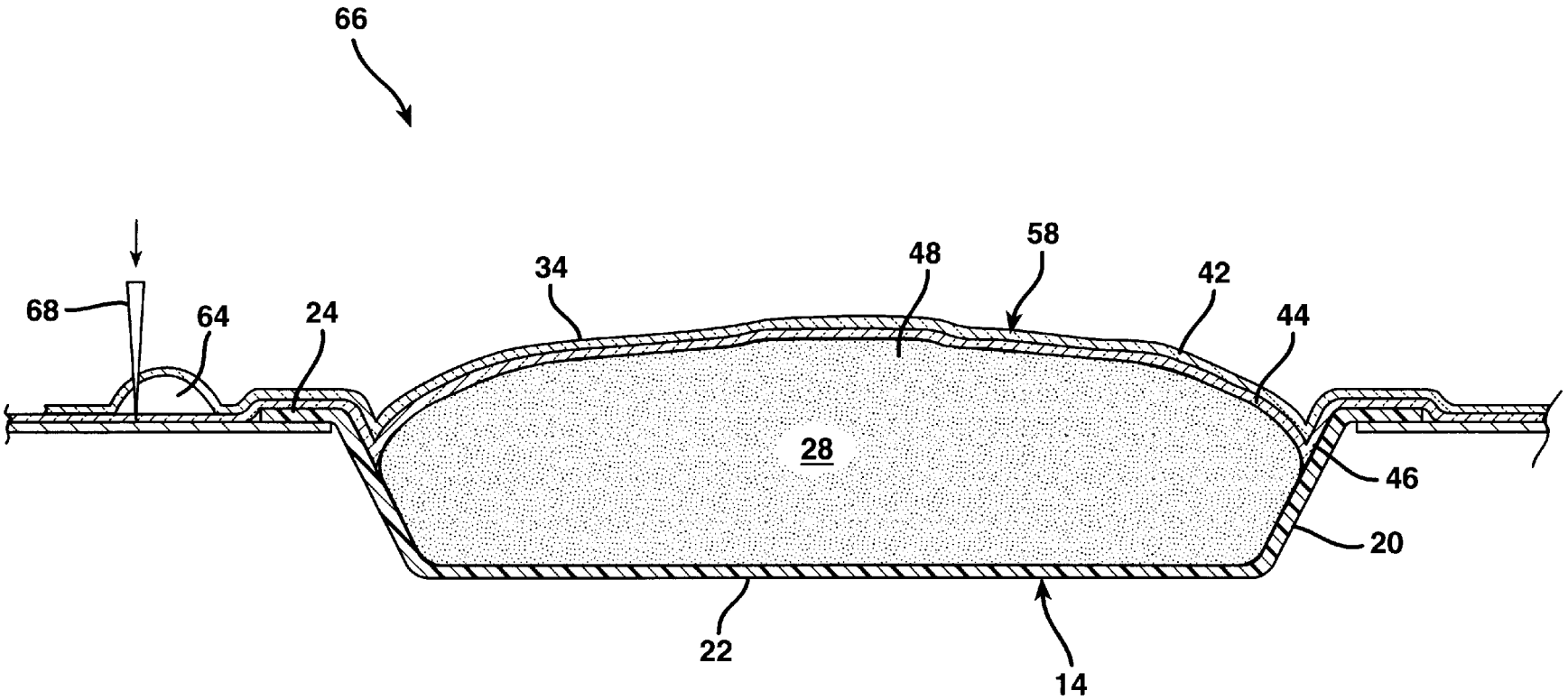
FIG. 6 is an enlarged cross-sectional view of packaging station 66 as shown in FIG. 1.

After the predetermined, separated region 64 has been created in packaging station 60, the final step in the packaging method in accordance with the present invention is to sever film 34 within the separated region 64 at packaging station 66 as shown in FIG. 6. As a result, an edge 70 is formed on the first film component 42 within the separated region 64, thereby providing a tab 72 for peeling the first film component 42 from the second component 44 of film 34 (see FIGS. 7–8). For this purpose, severing mechanism 68 may be employed as shown. Mechanism 68 is preferably a sharpened cutting instrument capable of severing film 34 with a single downward movement. If desired, the severing mechanism 68 may be heated, e.g., to increase its operating speed, depending upon the severability of film 34, provided that such heat does not cause components 42 and 44 to rejoin to one another during the severing operation at packaging station 66.

The severing mechanism 68 is preferably translatable between two positions (as indicated by the double arrow in FIG. 1): an "up" position" (not shown) to allow VSPs 58 to move beneath the mechanism 68 when carrying mechanism 12 transports the VSPs between packaging stations 66 and 69; and a "down" position (as shown) where the mechanism preferably severs both first and second film components 42, 44 in the same movement. In this manner, not only is peel tab 72 created, but the finished packages 58 are completely severed from the film web 34 so that the packages can be removed from apparatus 10 at off-loading station 69. It is also preferred that packaging station 66 have any additional severing mechanisms that are necessary to trim any excess film from VSPs 58 so that the final package has a neat appearance as shown in FIG. 7.

Figure 8:
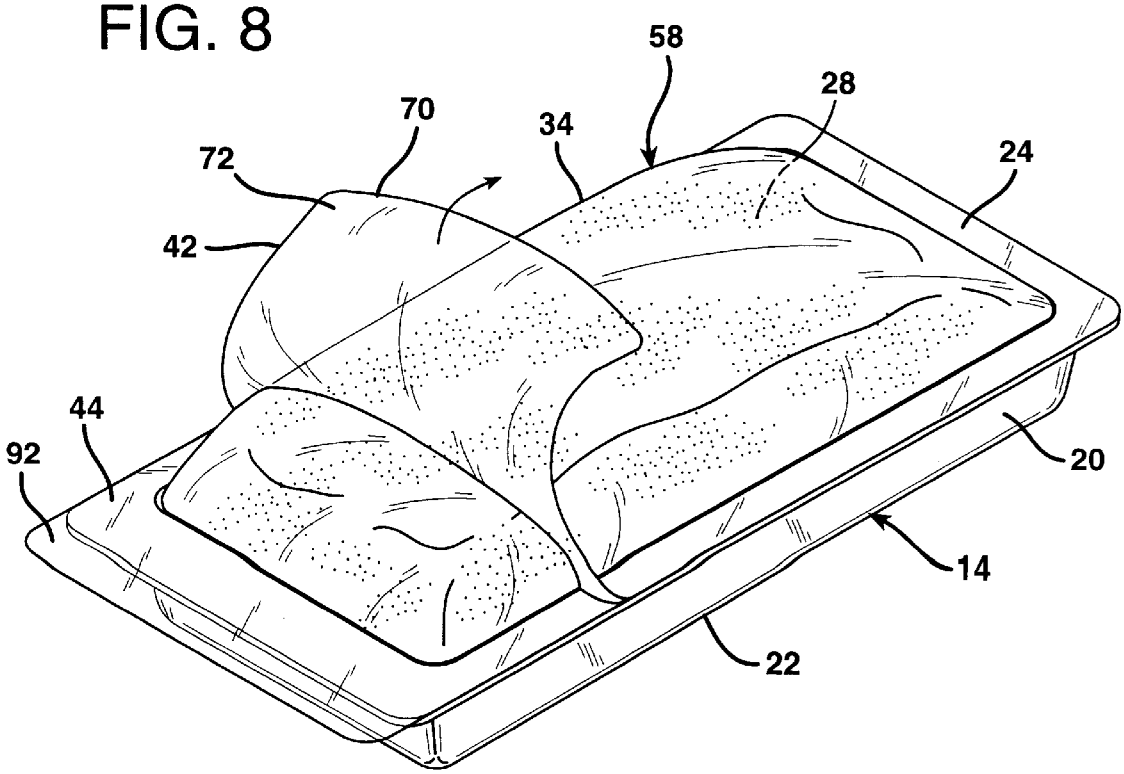
FIG. 8 is the package of FIG. 7, showing the first film component 42 being peeled from the second film component 44.

As a result of the severing operation at packaging station 66, it is preferred that an extended portion 92 of second film component 44 remains on VSP 58, and extends from flange 24 to essentially the same extent that peel tab 72 extends therefrom (see FIGS. 7–8). At retail, the first film component 42 can thus be peeled from VSP 58 by grasping peel tab 72 in one hand and the extended portion 92 of second film component 44 with the other hand, and then pulling the first film component 42 across the top of the VSP as shown in FIG. 8. This is preferred, but not necessary, to provide a convenient means for holding VSP 58 stationary during the peeling operation, thereby providing an opposing force at extended portion 92 to the peel force being applied at peel tab 72. It is to be understood, however, that it is not necessary that either peel tab 72 of first film component 42 or portion 92 of second film component 44 extends beyond flange 24 of support member 14. Rather, film 34 on VSP 58 can be completely coextensive with flange 24. In this case, peel tab 72 would be a portion of film component 42 that is separated from second component 44 within the width of one of the flanges 24, but outside of the sealed enclosure 48 within which the product 28 is ensconced.

What is claimed is:

1. A packaging method, comprising:

a. providing a film comprising a first film component peelably adhered to a second film component;

b. providing a support member for supporting a product thereon;

c. forming a seal between said second film component and said support member, said seal extending around the product to define a sealed enclosure for said product between said film and said support member;

d. separating said first film component from said second film component within a predetermined region of said film located outside of said sealed enclosure; and e. severing said film within said predetermined, separated region to form an edge on said first film component within said separated region, thereby providing a tab for peeling said first film component from said second film component.

2. The method of claim 1, wherein first and second film components are separated by directing fluid pressure between said first and second film components within said predetermined region.

3. The method of claim 2, wherein said predetermined region is defined by applying to said film a containment force sufficient to substantially prevent said fluid pressure from separating said first and second film portions within said sealed enclosure.

4. The method of claim 3, wherein said containment force is provided by pressing a channeling device into contact with said film, said channeling device having an internal channel to contain said fluid pressure within said channel.

5. The method of claim 2, wherein said fluid pressure is supplied by air.

6. The method of claim 2, wherein said method further comprises the steps of:

a. removing a portion of said first film component at an edge of said film so that said second film component extends beyond said first film component; and b. directing said fluid pressure between said first and second film components where said second film component extends beyond said first film component.

7. The method of claim 2, wherein said method further comprises the steps of:

a. removing a portion of said second film component at an edge of said film so that said first film component extends beyond said second film component; and b. directing said fluid pressure between said first and second film components where said first film component extends beyond said second film component.

8. The method of claim 1, wherein said first film component is substantially gas-impermeable and said second film component is gaspermeable.

9. The method of claim 8, wherein said support member is substantially gas-impermeable and said product is selected from the group consisting of meat, poultry, cheese, and produce.

10. The method of claim 9, further including the step of at least partially evacuating said sealed enclosure.

11. A packaging apparatus, comprising:

a. a mechanism for carrying a support member having a product thereon;

b. an apparatus for positioning a film over said support member, said film comprising a first film component peelably adhered to a second film component;

c. a device for forming a seal between said second film component and said support member, said seal extending around the product to define a sealed enclosure for said product between said film and said support member;

d. an apparatus for separating said first film component from said second film component within a predetermined region of said film located outside of said sealed enclosure; and e. a mechanism for severing said film within said predetermined, separated region to form an edge on said first film component within said separated region, thereby providing a tab for peeling said first film component from said second film component.

12. The apparatus of claim 11, wherein said apparatus for separating said first and second film components directs fluid pressure between said first and second film components within said predetermined region.

13. The apparatus of claim 12, wherein said apparatus for separating said first and second film components defines said predetermined region by applying to said film a containment force sufficient to substantially prevent said fluid pressure from separating said first and second film portions within said sealed enclosure.

14. The apparatus of claim 13, wherein said containment force is provided by pressing a channeling device into contact with said film, said channeling device having an internal channel to contain said fluid pressure within said channel.

15. The apparatus of claim 12, wherein said fluid pressure is supplied by air.

16. The apparatus of claim 12, wherein a portion of said first film component has been removed at an edge of said film so that said second film component extends beyond said first film component, said separating apparatus directing said fluid pressure between said first and second film components where said second film component extends beyond said first film component.

17. The apparatus of claim 12, wherein a portion of said second film component has been removed at an edge of said film so that said first film component extends beyond said second film component, said separating apparatus directing said fluid pressure between said first and second film components where said first film component extends beyond said second film component.

18. The apparatus of claim 11, further including a mechanism for at least partially evacuating said scaled enclosure.

* * * * *